US006070502A

United States Patent [19]

Chang

[11] Patent Number: 6,070,502

[45] Date of Patent: Jun. 6, 2000

[54] RATCHET BOX WRENCH

[76] Inventor: Jui-Ling Chang, P.O. Box 82-144, Taipei, Taiwan

[21] Appl. No.: 09/224,890

[22] Filed: Dec. 31, 1998

[51] Int. Cl.[7] ..... B25B 13/46

[52] U.S. Cl. ..... 81/63; 8/63.2

[58] Field of Search ..... 81/60–63.2

[56] References Cited

U.S. PATENT DOCUMENTS

| | | | |
|---|---|---|---|
| 1,635,102 | 7/1927 | Watson | 81/63 |
| 4,748,875 | 6/1988 | Lang | 81/63 |
| 5,144,869 | 9/1992 | Chow | 81/63 |
| 5,582,080 | 12/1996 | Barmore | 81/63 |
| 5,603,247 | 2/1997 | Wei | 81/63.2 |

*Primary Examiner*—James G. Smith
*Assistant Examiner*—David B. Thomas
*Attorney, Agent, or Firm*—A & J

[57] ABSTRACT

A ratchet box wrench includes a frame having two chambers at two ends, a packing member fitted in an intermediate portion of a frame and having two recesses at two ends, a first lug mounted in one of said chambers and provided with a pin at a top thereof, a second lug mounted in another one of said chambers and provided with a pin at a bottom thereof, a pair of outer plates fastened on two sides of said packing member, a pair of switching members each having an elongated portion at an end at an end having a longitudinal open slit at an intermediate portion, two ratchet box installed in said two chambers, a pair of pawls each rotatably mounted on one of said outer plates and disposed in one of said chambers, and a pair of springs each having a circular loop adapted to engage with said pin of one of said first and second lugs, a side loop engaged with a hook of said switching member, and a leg fitted in said cavity of one of said pawls, and two buttons each engaged with said raised portion of a respective one of said switching members.

1 Claim, 6 Drawing Sheets

RATCHET BOX WRENCH

BACKGROUND OF THE INVENTION

1. Field of the Invention

This invention is related to an improvement in the structure of a ratchet box wrench.

2. Description of the Prior Art

Referring to FIGS. 6 and 7, the conventional ratchet box wrench includes a frame in which are mounted two outer plates 1, two ratchet boxs 3, two pawls 4, two balls 5 and two springs 6 by rivets 2. The frame has two chambers 8 at two ends thereof adapted to receive the ratchet boxs 3. The frame is formed with two openings 9 for the passage of the teeth of the pawls 4. When desired to change the rotatable direction of the ratchet box 3, it is necessary to press a tooth of the pawl 4 into the frame thereby urging another tooth of the pawl 4 to engage with the ratchet box 3.

However, it is necessary to use a block (not shown) to seal the openings 9 of the frame in manufacture thereby increasing the cost. In addition, the rivets 2 must be first inserted through the pawls 4 and then disposed at an inclined position in order to fit the teeth of the pawls 4 out of the openings 9 thus making it very difficult to assemble and therefore further increasing the cost.

Therefore, it is an object of the present invention to provide an improved ratchet box wrench which can obviate and mitigate the above-mentioned drawbacks.

SUMMARY OF THE INVENTION

This invention is related to an improvement in the structure of a ratchet box wrench.

It is the primary object of the present invention to provide an improved ratchet box wrench which is simple in construction.

It is another object of the present invention to provide an improved ratchet box wrench which is low in cost.

It is still another object of the present invention to provide an improved ratchet box wrench which is easy to assemble.

It is still another object of the present invention to provide an improved ratchet box wrench which can be switched with only one hand.

It is a further object of the present invention to provide an improved ratchet box wrench which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
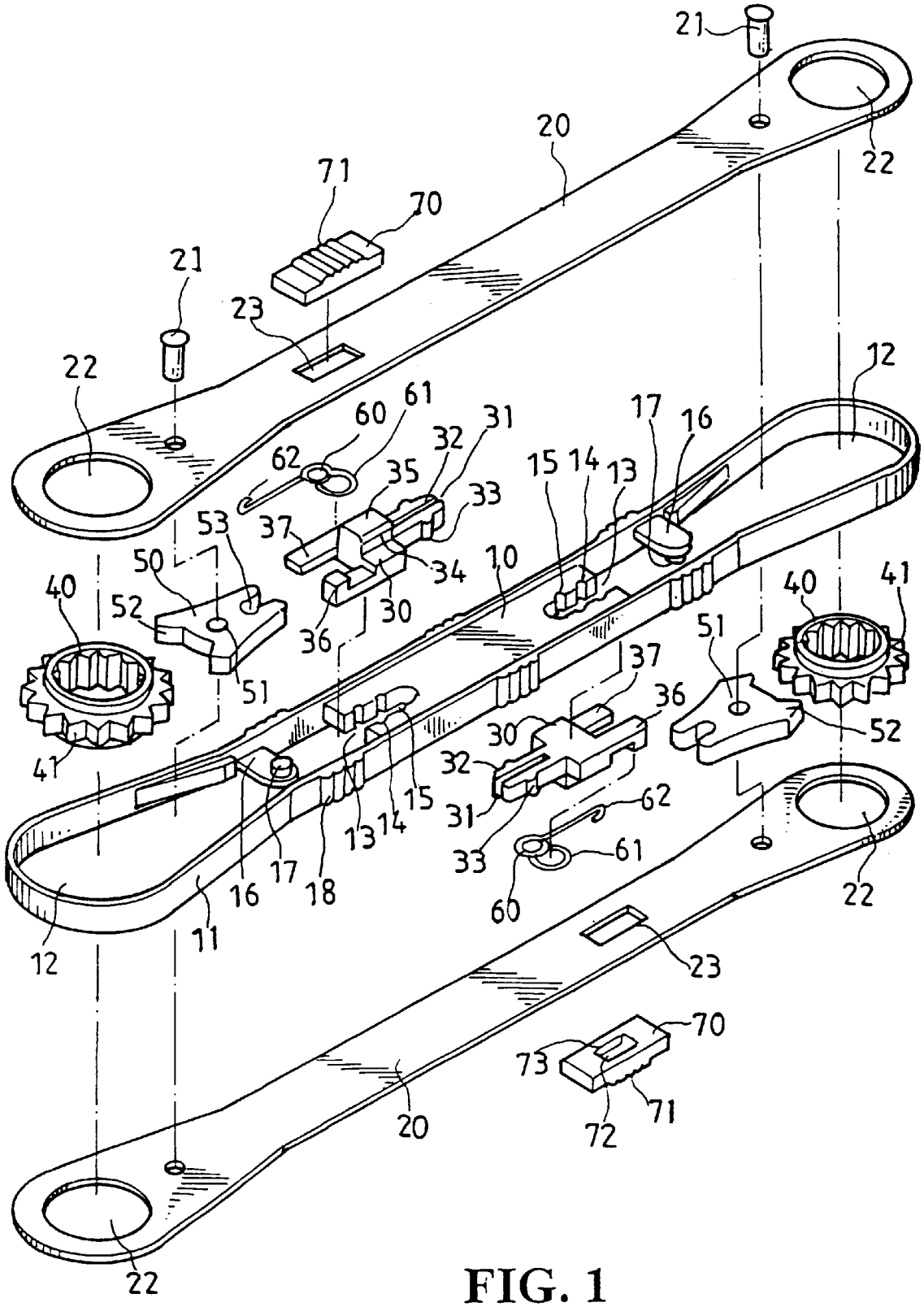
FIG. 1 is an exploded view of the present invention.
Figure 2:
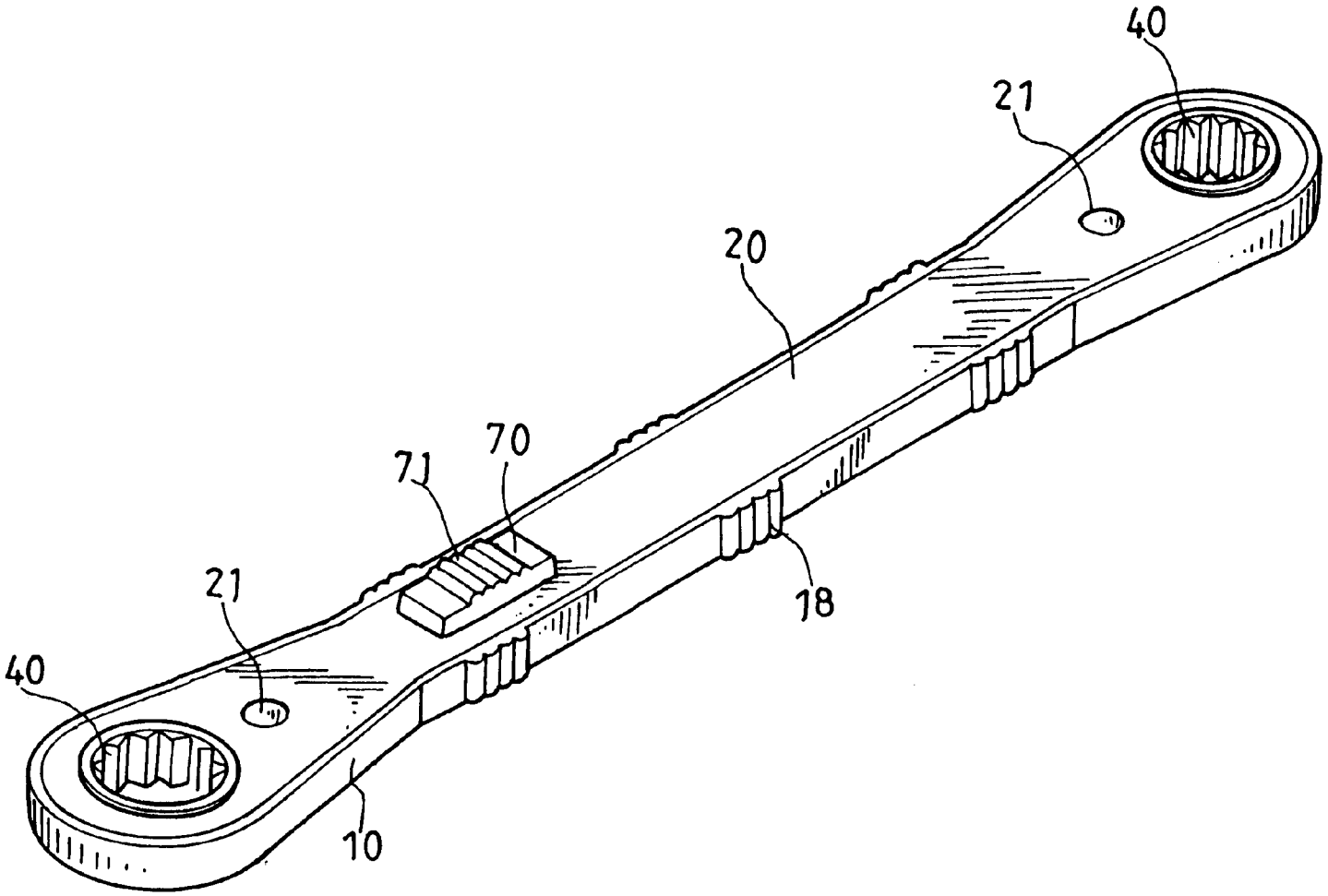
FIG. 2 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIGS. 1, 2, 3 and 4 thereof, the ratchet box wrench according to the present invention generally comprises a packing member 10, a frame 11, a pair of outer plates 20, a pair of switching members 30, two ratchet box 40, two pawls 50, two springs 60, and two buttons 70.

The packing member 10 is fitted in the intermediate portion of the frame 11 which has two first chambers 12 at two ends thereof. The packing member 10 has two second chambers 13 at two ends thereof. The second chamber 13 is formed with a first and second grooves 14 and 15. A first lug 16 is mounted in one of the first chambers 12 and provided with a pin 17 at the top thereof. A second lug 16 is mounted in another one of the first chambers 12 and provided with a pin 17 at the bottom thereof. The frame 11 is provided with slip-proof protrusions 18 at the upperside thereof.

The outer plates 20 are fastened on two sides of the packing member 10 by rivets 21. The outer plate 20 has two circular openings 22 at two ends thereof for receiving the ratchet box 40 and a slot 23 close to one of the circular openings 22.

The switching member 30 has an elongated portion 32 at an end having a longitudinal open slit 31 at the intermediate portion thereby forming two arms each with a projection 33 engageable with the grooves 14 and 15 of the packing member 10. The switching member 30 has a raised portion 35 formed with two protruded lines 34 at two opposite sides thereof. Another end of the switching member 30 is provided with a hook 36 and a shoulder 37 disposed on the lug 16 for guiding the movement of the switching member 30 in the frame 11.

The two ratchet box 40 are installed in the two first chambers 12 of the frame 11.

The pawl 50 has a center hole 51 for receiving a rivet 21 and rotatably mounted on the outer plate 20 by the rivet 21 so that when the outer plate 20 is fitted in the frame 11, the pawl 50 is disposed in the first chamber 12 of the frame 11. The pawl 50 has two teeth 52 at one end engageable with the teeth 41 of the ratchet box 40 and a cavity 53 at another end.

Figure 3:
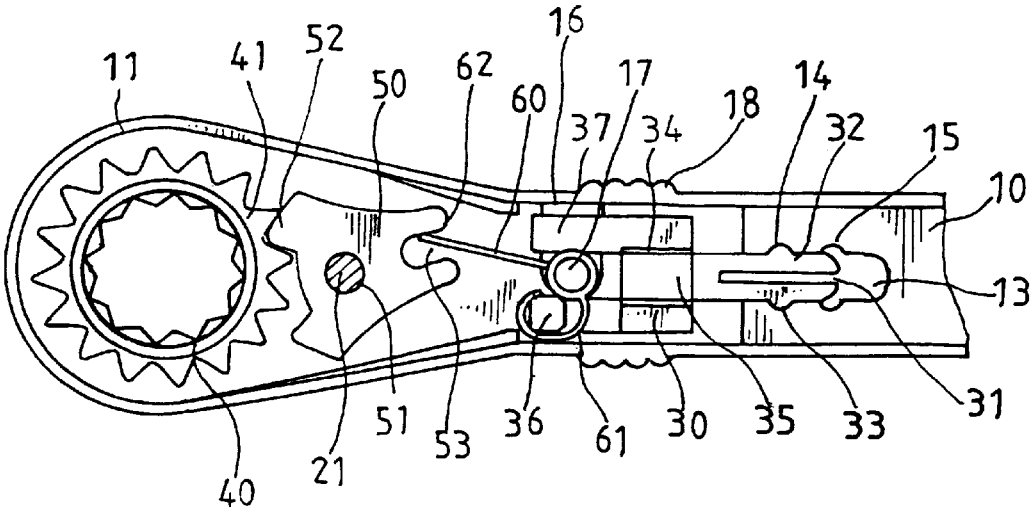
FIGS. 3 and 4 illustrate the working principle of the present invention.
Figure 4:
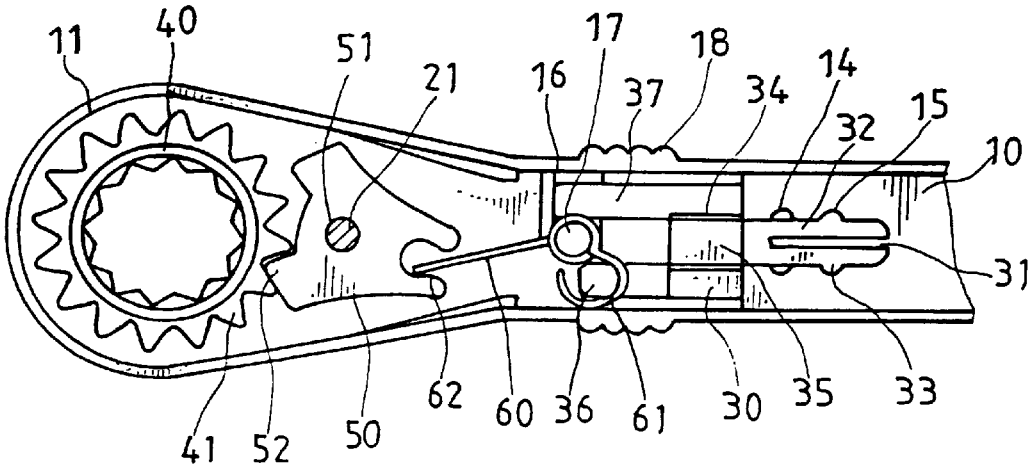

The spring 60 has a circular loop at the central portion adapted to engage with the pin 17 of the lug 16, a side loop 61 engaged with the hook 36 of the switching member 30, and a leg 62 fitted in the cavity 53 of the pawl 50 (see FIGS. 3 and 4).

The button 70 is provided at the top with raised lines 71 and at the bottom with a hole 72 having two opposite hooked edges engaged with the protruded lines 34 of the raised portion 35 of the switching member 30.

Referring to FIG. 3, when the button 30 is pushed to the left, the switching member 30 will be moved forward thereby causing the protuberances 33 of the switching member 30 to move from the groove 15 to the groove 14 and therefore urging the leg 62 of the spring 60 to rotate the pawl 50 to engage with the ratchet box 40, so that the ratchet box 40 can be rotated in counterclockwise direction only.

In the contrary, when the button 30 is pushed to the right (see FIG. 4), the switching member 30 will be moved backward thereby causing the protuberances 33 of the switching member 30 to move the groove 14 to the groove 15 and therefore urging the leg 62 of the spring 60 to rotate the pawl 50 to engage with the ratchet box 40, so that the ratchet box 40 can be rotated in clockwise direction only.

Figure 5:
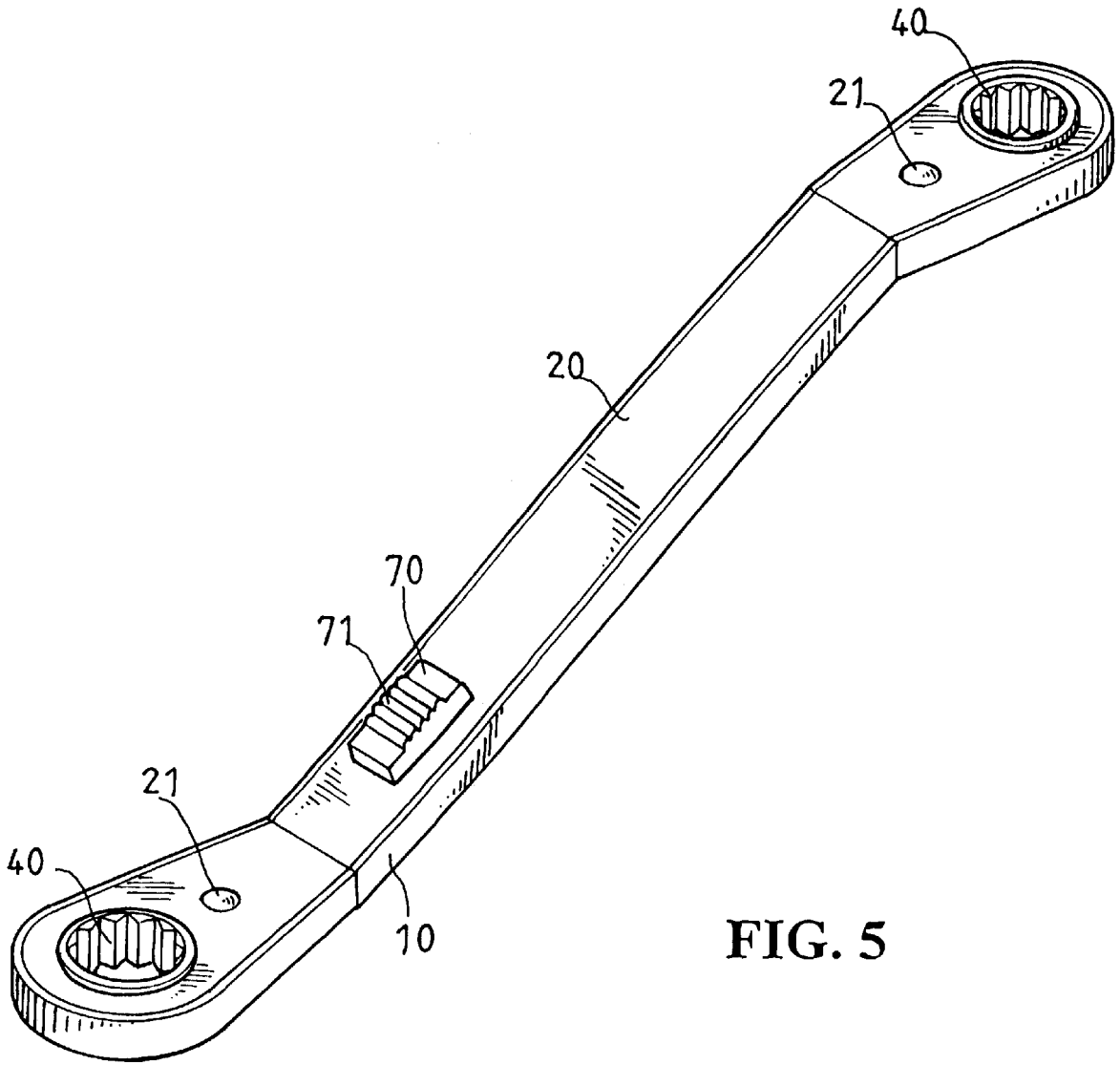
FIG. 5 illustrates another preferred embodiment of the present invention.
Figure 6:
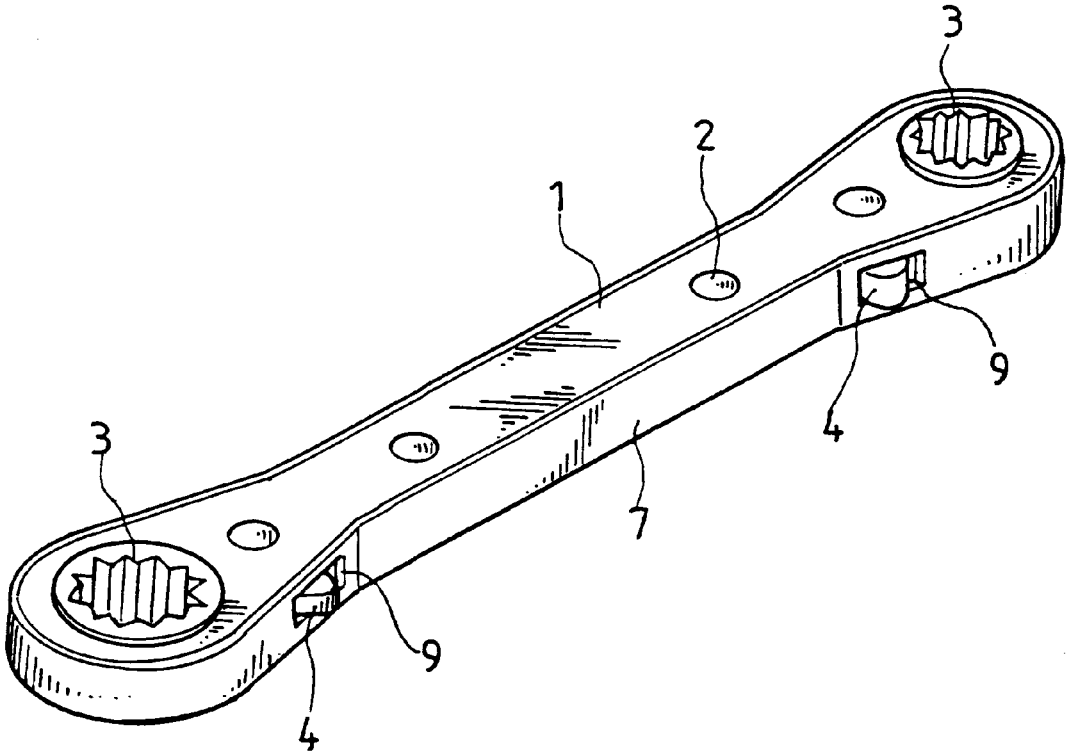
PRIOR ART FIG. 6
FIG. 6 is a perspective view of a prior art ratchet-type box wrench.
Figure 7:
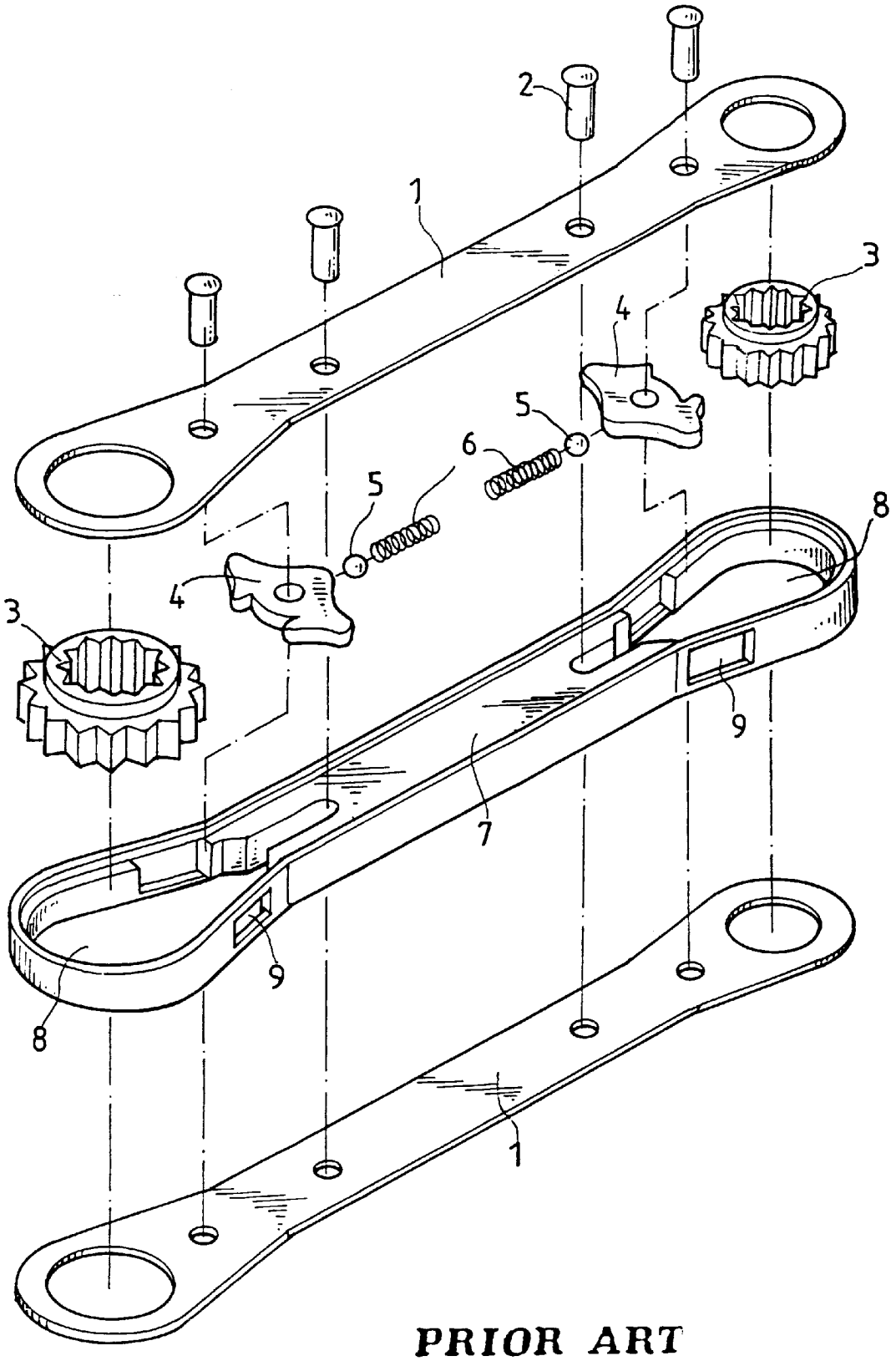
PRIOR ART FIG. 7
FIG. 7 is an exploded view of the prior art ratchet-type box wrench.

FIG. 5 illustrates a second preferred embodiment of the present invention. As shown, the outer plate 10 is an elongated member with an slanting intermediate portion and two horizontal ends.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A ratchet box wrench comprising:

a frame having two chambers at two ends;

a packing member fitted in an intermediate portion of a frame and having two recesses at two ends, each of said recesses being formed with two grooves;

a first lug mounted in one of said chambers and provided with a pin at a top thereof;

a second lug mounted in another one of said chambers and provided with a pin at a bottom thereof;

a pair of outer plates fastened on two sides of said packing member, each of said outer plates having two circular openings at two ends thereof and a slot close to one of said circular openings;

a pair of switching members each having an elongated portion at an end having a longitudinal open slit at an intermediate portion thereby forming two arms each with a projection engageable with said grooves of said packing member, said switching member having a raised portion formed with two protruded lines at two opposite sides thereof, another end of said switching members being provided with a hook and a shoulder disposed on one of said first and second lugs;

two ratchet box installed in said two chambers;

a pair of pawls each rotatably mounted on one of said outer plates and disposed in one of said chambers, each of said pawl having two teeth at one end engageable with teeth of said ratchet box and a cavity and a cavity at another end;

a pair of springs each having a circular loop adapted to engage with said pin of one of said first and second lugs, a side loop engaged with a hook of said switching member, and a leg fitted in said cavity of one of said pawls; and two buttons each engaged with said raised portion of a respective one of said switching members.

* * * * *